United States Patent [19]

Richard et al.

[11] Patent Number: 4,459,829

[45] Date of Patent: Jul. 17, 1984

[54] RIGIFIED EARRING POST

[75] Inventors: Armand C. Richard, Plainville; Michael A. Gayton, North Attleboro, both of Mass.; Anthony F. D'Ambra, Greenville, R.I.

[73] Assignee: Leach & Garner Company, Attleboro, Mass.

[21] Appl. No.: 445,059

[22] Filed: Nov. 29, 1982

[51] Int. Cl.[3] ..... A44C 7/00

[52] U.S. Cl. ..... 63/12; 29/160.6; 29/530; 428/577

[58] Field of Search ..... 63/12, 13; 29/160.6, 29/530; 428/577

[56] References Cited

U.S. PATENT DOCUMENTS

| | | | |
|---|---|---|---|
| 2,457,599 | 12/1948 | Pessel | 29/530 |
| 4,307,582 | 12/1981 | Mancini | 63/12 |
| 4,383,002 | 5/1983 | Manolescu | 428/577 X |

*Primary Examiner*—F. Barry Shay

*Attorney, Agent, or Firm*—Barlow & Barlow, Ltd.

[57] ABSTRACT

A hollow precious metal earring post that has a notch in the wall thereof to receive a clutch is disclosed, which post has a solid gold solder metal interior from the radiused end to a point beyond the notch to rigify and support the post along the notched area.

2 Claims, 3 Drawing Figures

RIGIFIED EARRING POST

BACKGROUND OF THE INVENTION

The present invention relates to pierced earrings, and is particularly concerned with a rigified hollow earring point, which forms part of the earring, namely the part that passes through an aperture in the ear lobe of the wearer.

Hollow earring posts have been suggested as seen in the U.S. Pat. No. 4,307,582 and have become a popular item due to the fact that the price of gold and silver have increased, it being necessary, for the most part, in order to have a post that is not subject to contamination, to use a precious metal which should be of a fineness in gold of better than 14 karat. In using posts constructed as set forth in the aforementioned patent specification, weak areas have been found at the depressions that are placed in the posts, which has caused some posts to break at this particular location. It can be appreciated that a broken tip can have serious health repercussions and therefore, the need for a technical advance in the design and fabrication of a hollow pin or post for a pierced earring assembly is indicated. The subject invention therefore overcomes this defect by uniquely strengthening the area where the groove or depression exists by partially filling the hollow post with solder.

DESCRIPTION OF THE PREFERRED EMBODIMENT

Figure 1:
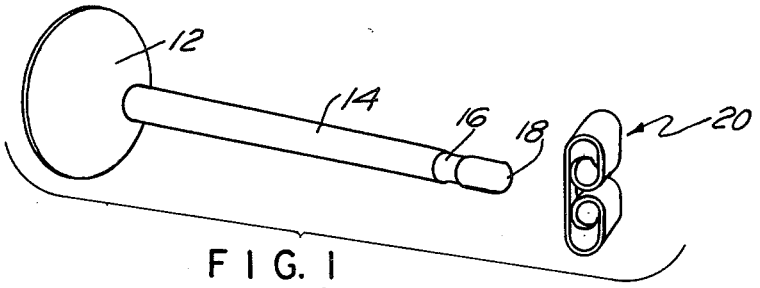
FIG. 1 is an exploded perspective view of an illustrative earring with a post constructed in accordance with the invention showing an illustrative clutch for use therewith.
Figure 2:
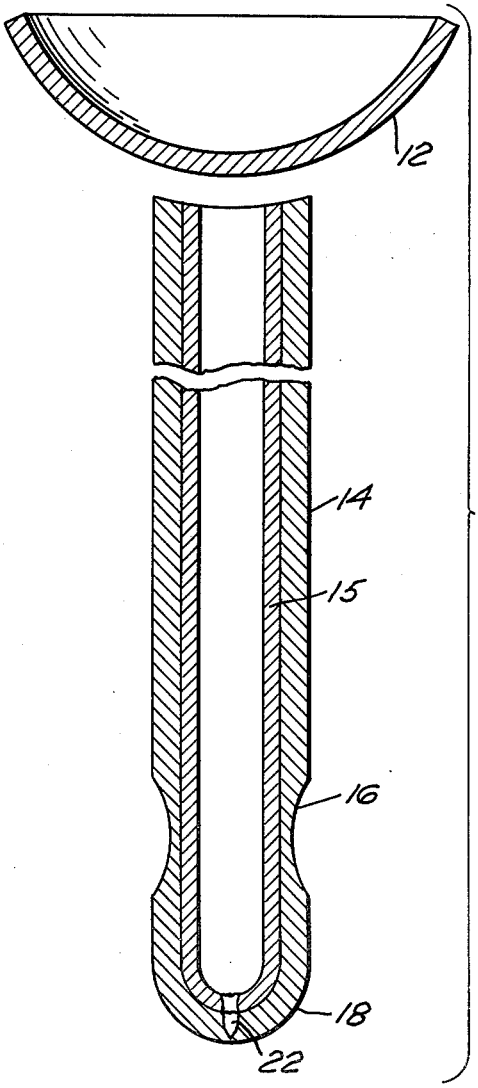
FIG. 2 is an enlarged detached central sectional view illustrating an intermediate step in the making of a part of the earring.

The earring illustrated in FIG. 1 comprises an ornament such as 12 to which is fastened a post 14 that is provided with a depression or recess 16 near a rounded end as at 18. On to this post a clutch, generally designated 20, may be slipped to engage in the depression or recess 16, the clutch being in the form of a friction nut. The post 14 made in accordance with the instant invention, can be manufactured in a number of ways. For example, one practical form of construction is to form the body member from sheet stock, which is coated on one side with gold solder 15, known as a solder flush layer. Such a solder is substantially gold alloyed with other metals such as copper, zinc and tin. The coated sheet stock is then drawn by a plurality of successful drawing operations, into an elongated tubular form, so that the precious metal itself is on the outside and the solder flush layer is on the inside. Such a drawing arrangement, for example, is illustrated in the U.S. Pat. No. 1,840,285.

Figure 3:
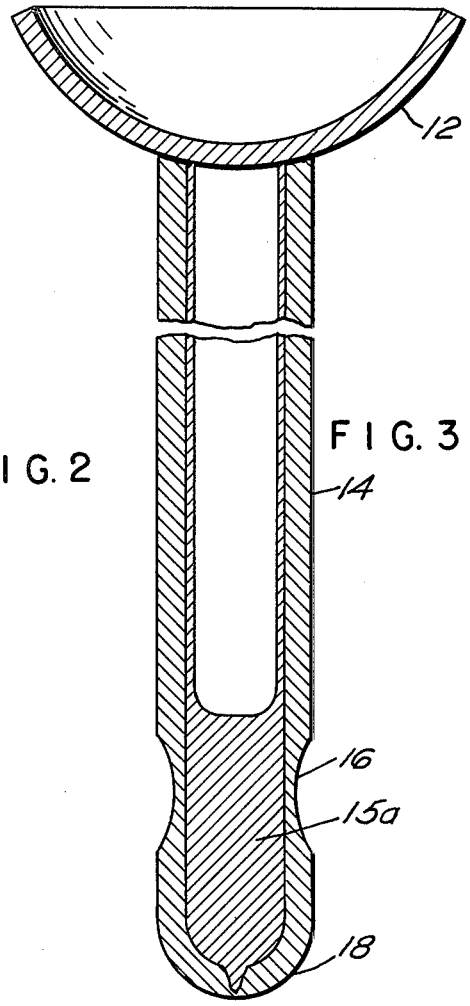
FIG. 3 is a sectional view of the completed article.

Certain other methods of forming posts are possible, but in the forming of the post which has a diameter slightly less than one millimeter, it has been found by taking microphotographs, that the tubing at the radiused end 18 will have defects therein such as the exaggerated defect in the form of a discontinuity of the inner surface such as the rupture in the wall along the inner surface as at 22. Inspection of various items will reveal that the fractures in the wall will occur at different points, but in any event, fractures do occur and this leads to a problem of providing a radiused end which is strong and with a continuous layer of metal. To achieve this and to strengthen the post, particularly at the depression or recess 16, a preferred process would be to take the formed post with the interior solder layer 15 and clean and degrease it. After that, the post would be placed into a furnace with the open end upright and the radiused end 18 being pointing downward. The position is important since the area that will be filled with gold solder during the operation will be adjacent the radiused end and it is important to have the gold solder flush fill and seal the radiused end to a point well above the recess or depression 16. In this way, the end may be completely and solidly filled to yield the realization of strength and integrity of the working end of the earpost. After the solder 15*a* has been flushed into the end as seen in FIG. 3, it will be apparent that all of the area at the end of the post has been filled together with the slight defect. In this condition the post may be mechanically staked and/or soldered to an ornament such as 12, by placing solder on the end of the post to accomplish that operation, and/or staking the post to the ornament.

We claim:

1. An earring post comprising a hollow precious metal tubular member having an open end and a closed radiused end, at least one notch formed inwardly in the wall of the member to receive a clutch, said member having a gold solder solid interior from the radiused end to a point beyond the notch to support the post along the notched area whereby the closed end of the post is rigidified.

2. An earring post as in claim 1 in combination with an ornament, the open end being secured to the ornament.

* * * * *